US005713440A

United States Patent [19]

Chen

[11] Patent Number: 5,713,440

[45] Date of Patent: Feb. 3, 1998

[54] POSITIONING AND EJECTING DEVICE FOR A RETRACTABLE HANDLE

[76] Inventor: Shou-Mao Chen, 58, Ma Yuan West St., Taichung, Taiwan

[21] Appl. No.: 643,019

[22] Filed: May 2, 1996

Related U.S. Application Data

[63] Continuation-in-part of Ser. No. 501,421, Jul. 3, 1995, abandoned.

[51] Int. Cl.[6] ..... A45C 13/22; A45C 13/26

[52] U.S. Cl. ..... 190/115; 190/39; 16/115

[58] Field of Search ..... 190/39, 115, 12 R; 16/115; 280/37, 655, 655.1, 47.315

[56] References Cited

U.S. PATENT DOCUMENTS

| | | | |
|---|---|---|---|
| 4,792,025 | 12/1988 | Thomas | 190/18 A |
| 4,974,871 | 12/1990 | Mao | 16/115 X |
| 5,355,980 | 10/1994 | Hsieh | 190/18 A X |
| 5,414,895 | 5/1995 | Kazmark, Jr. | 16/115 |
| 5,438,731 | 8/1995 | Kazmark, Jr. | 16/115 |
| 5,459,908 | 10/1995 | Chen | 16/115 |
| 5,488,756 | 2/1996 | Hsieh | 16/115 |
| 5,500,981 | 3/1996 | Ho | 16/115 |
| 5,513,873 | 5/1996 | Chen | 280/37 X |
| 5,526,908 | 6/1996 | Wang | 190/18 A X |

*Primary Examiner*—Sue A. Weaver

[57] ABSTRACT

A suitcase has an interior to receive a seat. The seat has a frame disposed on the upper periphery of the suitcase. The frame has a generally U-shaped groove. Two opposite flanges are protruded inwardly in the two sides of the frame. A retractable handle has a grip and two parallel inner pipes. The inner periphery of the inner pipe has a rail to receive a rack. A generally U-shaped top cover plate covers the seat. A chamber is formed in the seat. A positioning plate is disposed beneath the notch transversely, and an L-shaped rail plate is disposed above the notch transversely. Two inserting blocks are inserted in the notches. The outer end of each block has rectangular dents to match the rectangular teeth of the rack. A button is disposed between two rail plates. A front cover plate covers the front opening of the seat.

1 Claim, 4 Drawing Sheets

POSITIONING AND EJECTING DEVICE FOR A RETRACTABLE HANDLE

The present invention is a continuation-in-part of application Ser. No. 08/501,421, filed Jul. 3, 1995, now abandoned.

BACKGROUND OF THE INVENTION

The present invention relates to a retractable handle in a suitcase. More particularly, the present invention relates to a positioning and ejecting device for a retractable handle.

A conventional handle is always protruded over a suitcase. The handle is easily broken or bent while the suitcase is consigned for shipment.

SUMMARY OF THE INVENTION

An object of the present invention is to provide a positioning and ejecting device for a retractable handle which can be hidden in a suitcase.

Accordingly, a suitcase has an interior to receive a seat. A hollow top frame disposed on the seat is placed on the upper periphery of the suitcase. The hollow top frame has a generally U-shaped groove to receive a generally U-shaped grip of a retractable handle and a rectangular hole to receive a button. Two opposite flanges are protruded inwardly in the two sides of the hollow top frame in order to restrict a top cover plate. The retractable handle has the generally U-shaped grip with two square holes at two ends of the generally U-shaped grip and two parallel inner pipes which have corresponding upper ends inserted in the square holes. An inner plate is disposed in each inner pipe. An elongated recess is defined between each inner pipe and each corresponding inner plate to face the seat and to receive a rack which has a plurality of rectangular teeth on its surface. Each inner pipe is inserted in a corresponding outer pipe and moved in the corresponding outer pipe freely. Two opposite rectangular recesses are formed in two ends of the U-shaped groove longitudinally to receive two rectangular springs, respectively. A generally U-shaped top cover plate covers the U-shaped groove. Each rectangular spring encloses an upper portion of each corresponding inner pipe, respectively, to eject each corresponding inner pipes upward when the rectangular springs push upward against the cover plate which in turn pushes the U-shaped grip. The generally U-shaped cover plate has a square hole at each end thereon. A rectangular through hole is formed under each rectangular recess to receive a respective one of the outer pipes. Each outer pipe has a rectangular opening facing the seat. A chamber is formed in the seat. Two opposite rectangular slots are formed in two rectangular through holes respectively. A positioning plate is disposed beneath each rectangular slot transversely, and an L-shaped rail plate is disposed above each rectangular slot transversely. Two inserting blocks are inserted in the corresponding rectangular slots. Each inserting block is restricted between each corresponding positioning plate and each corresponding L-shaped rail plate, respectively. The outer end of each inserting block has a plurality of rectangular dents passing through each corresponding rectangular slot and each corresponding rectangular opening to match the rectangular teeth. Two opposite protrusions are disposed on the front and rear surfaces of each inserting block to be hooked by two extension springs. The button which has a main body with two opposite lateral notches and a pressing portion on the main body is disposed between two L-shaped rail plates. Two inserting blocks are inserted in the corresponding lateral notches to restrict a transverse motion of the button. The pressing portion is protruded over the top surface of the frame. Two positioning pipes are disposed on the corresponding L-shaped rail plates, respectively. A front cover plate which has two round holes to match the corresponding positioning pipes covers the front opening of the seat. Two bolts pass through the corresponding round holes of the front cover plate and the corresponding positioning pipes, respectively, to fasten the front cover plate and the frame together. A compression spring is disposed beneath the bottom of the button in the seat.

DETAILED DESCRIPTION OF THE INVENTION

Figure 1:
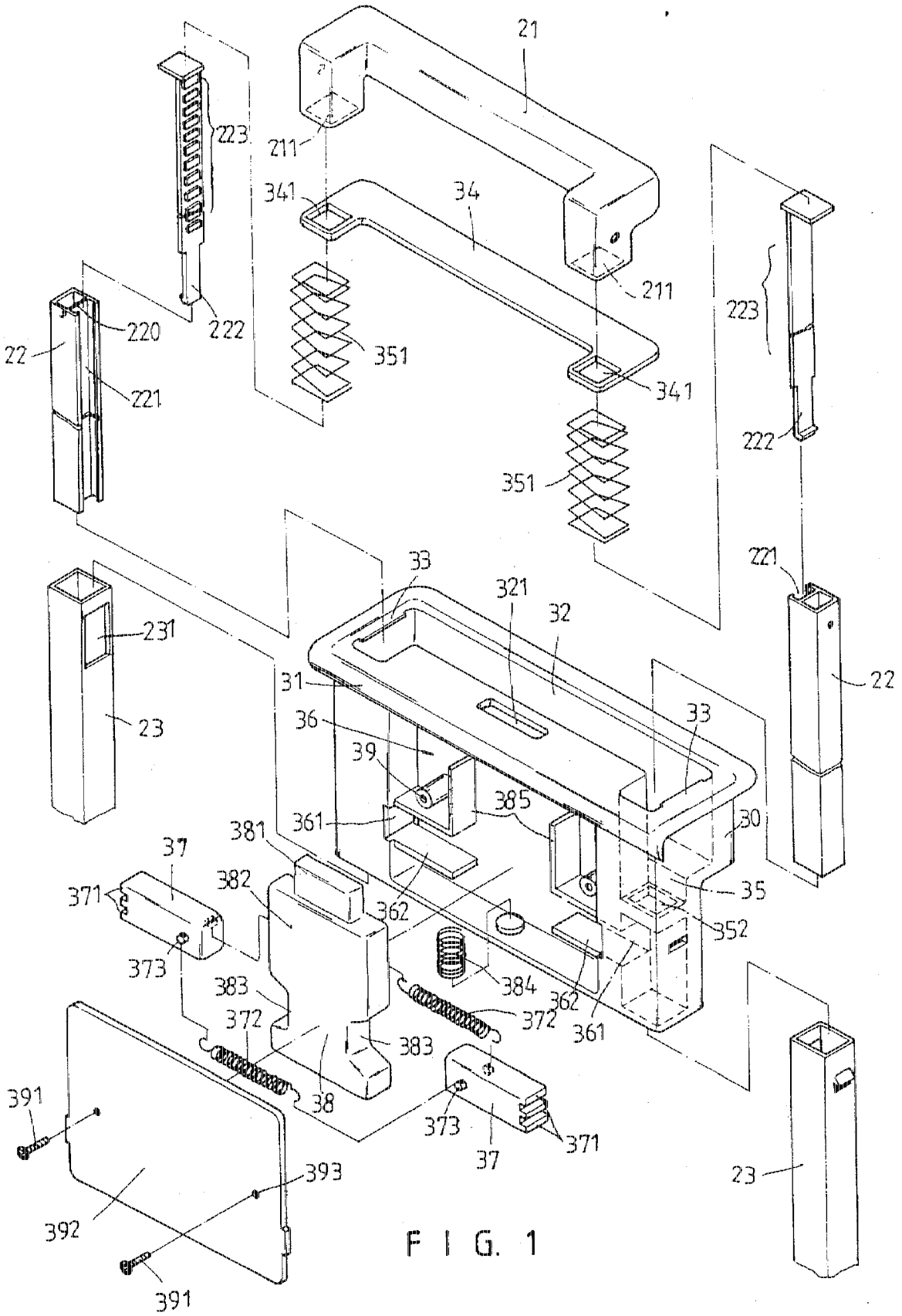
FIG. 1 is a perspective exploded view of a preferred embodiment in accordance with the invention.
Figure 2:
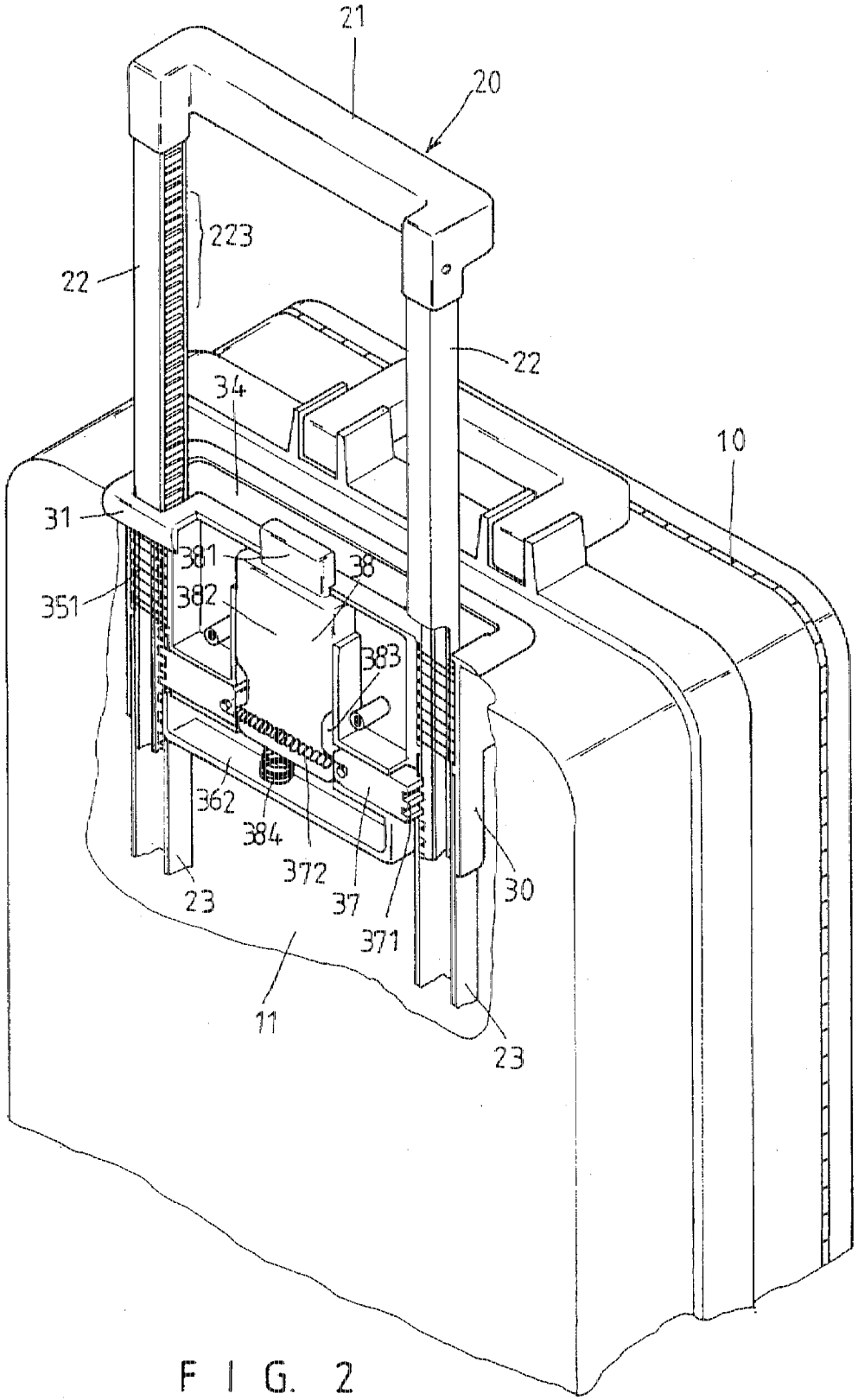
FIG. 2 is a schematic view illustrating a preferred embodiment of FIG. 1 in a suitcase.

Referring to FIGS. 1 and 2, a suitcase 10 has an interior 11 to receive a seat 30. A hollow top frame 31 disposed on the seat 30 is placed on the upper periphery of the suitcase 10. The hollow top frame 31 has a generally U-shaped groove 32 to receive a generally U-shaped grip 21 of a retractable handle 20 and a rectangular hole 321 to receive a button 38. Two opposite flanges 33 are protruded inwardly in the two sides of the hollow top frame 31 in order to restrict a top cover plate 34. The retractable handle 20 has the generally U-shaped grip 21 with two square holes 211 at two ends of the generally U-shaped grip 21 and two parallel inner pipes 22 which has corresponding upper ends inserted in the square holes 211. An inner plate 220 is disposed in each inner pipe 22. An elongated recess 221 is defined between each inner pipe 22 and each corresponding inner plate 220 to face the seat 30 and to receive a rack 222 which has a plurality of rectangular teeth 223 on its surface. Each inner pipe 22 is inserted in a corresponding outer pipe 23 and moved in the corresponding outer pipe 23 freely. Two opposite rectangular recesses 35 are formed in two ends of the U-shaped groove 32 longitudinally to receive two rectangular springs 351, respectively. A generally U-shaped top cover plate 34 covers the U-shaped groove 32. Each rectangular spring 351 encloses an upper portion of each corresponding inner pipe 22, respectively, to eject each corresponding inner pipes 22 upward when the rectangular springs 351 push upward against the cover plate 34 which in turn pushes the U-shaped grip 21. The generally U-shaped cover plate 34 has a square hole 341 at each end thereon. A rectangular through hole 352 is formed under each rectangular recess 35 to receive a respective one of the outer pipes 23. Each outer pipe 23 has a rectangular opening 231 facing the seat 30. A chamber 36 is formed in the seat 30. Two opposite rectangular slots 361 are formed in two rectangular through holes 352 respectively. A positioning plate 362 is disposed beneath each rectangular slot 361 transversely, and an L-shaped rail plate 385 is disposed above each rectangular slot 361 transversely. Two inserting blocks 37 are inserted in the corresponding rectangular slots 361. Each inserting block 37 is restricted between each corresponding positioning plate 362 and each corresponding L-shaped rail plate 385, respectively. The outer end of each inserting block 37 has a plurality of rectangular dents 371 passing through each corresponding rectangular slot 361 and each corresponding rectangular opening 231 to match the rectangular teeth 223. Two opposite protrusions 373 are disposed on the front and rear surfaces of each inserting block 37 to be hooked by two extension springs 372. The button 38 which has a main body 382 with two opposite lateral notches 383 and a pressing portion 381 on the main body 382 is disposed between two L-shaped rail plates 385. Two inserting blocks 37 are inserted in the corresponding lateral notches 383 to restrict a transverse motion of the button 38. The pressing portion 381 is protruded over the top surface of the frame. Each of the positioning pipes 39 is disposed in the chamber 36 adjacent each other of the corresponding L-shaped rail plates 385, respectively. A front cover plate 392 which has two round holes 393 to match the corresponding positioning pipes 39 covers the front opening of the seat 30. Two bolts 391 pass through the corresponding round holes 393 of the front cover plate 392 and the corresponding positioning pipes 39, respectively, to fasten the front cover plate 392 and the frame 30 together. A compression spring 384 is disposed beneath the bottom of the button 38 in the seat 30.

Figure 3:
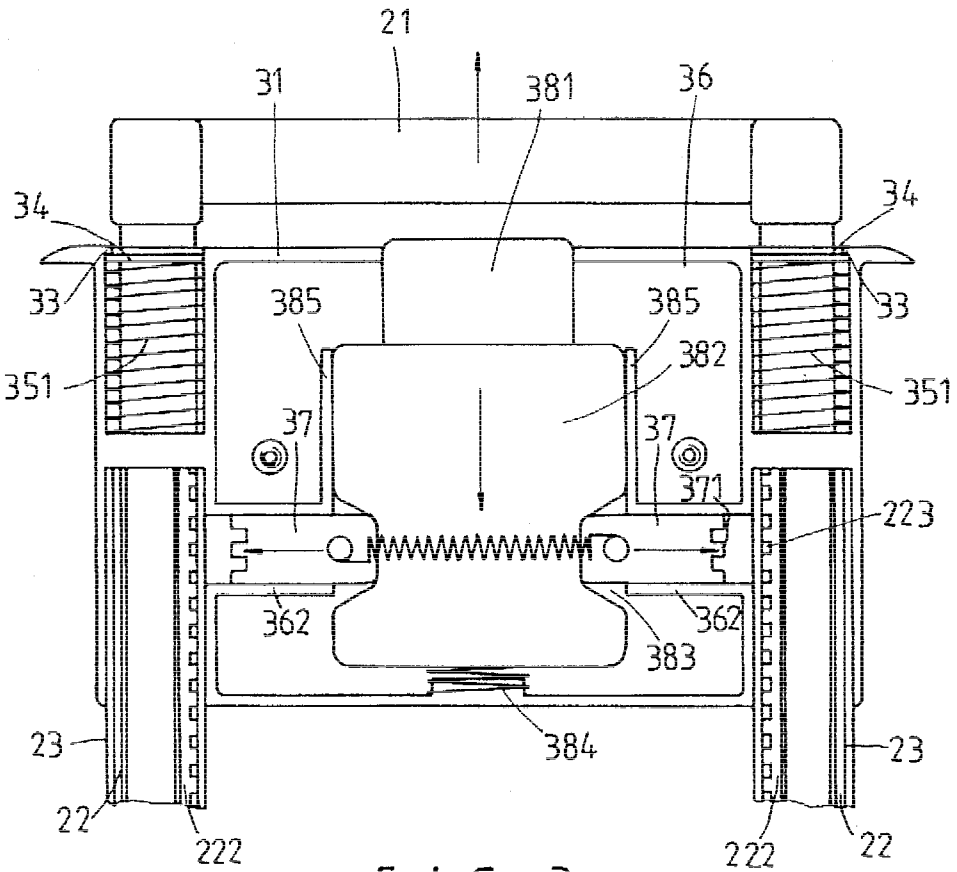
FIG. 3 is a schematic view showing the operative state of a preferred embodoment of FIG. 1.
Figure 4:
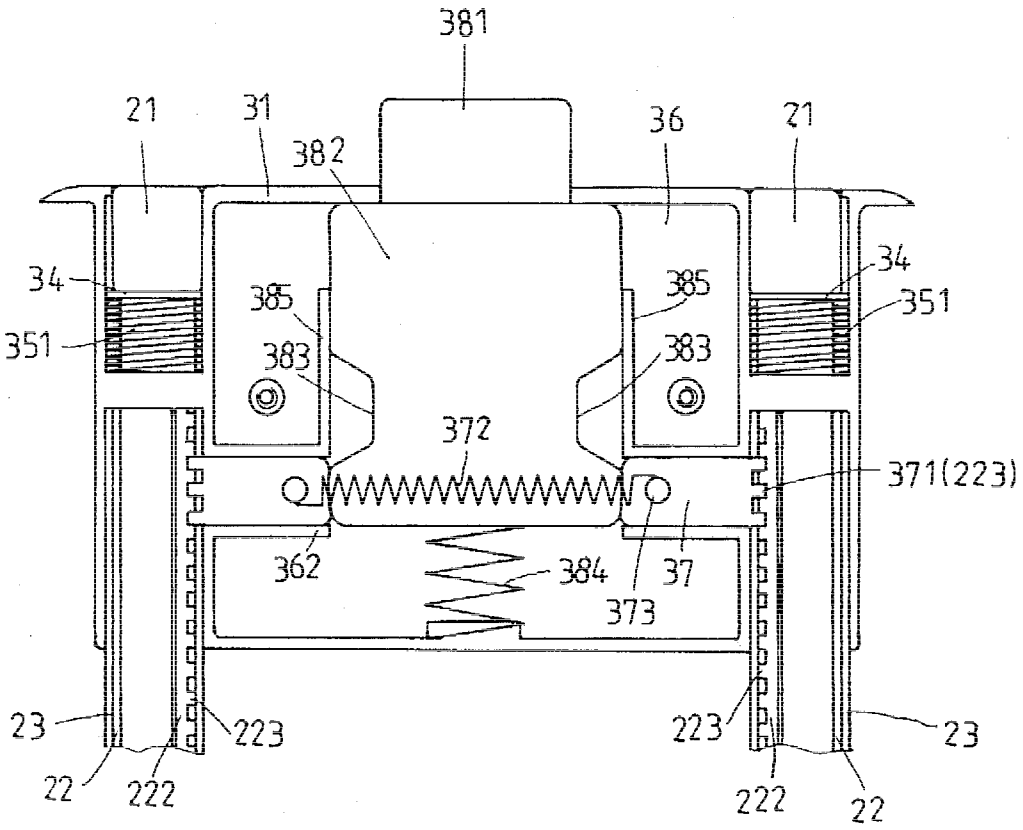
FIG. 4 is a schematic view showing the inoperative state of a preferred embodiment of FIG. 1.

Referring to FIGS. 2 and 3, the device of the present invention is in an operation state. When the user presses the pressing portion 381 of the button 38, the inserting blocks 37 will move from the bottom edges of the button 38 to the lateral notches 383 so that the rectangular dents 371 of the inserting blocks 37 release from the rectangular teeth 223 of the racks 222. The grip 21 is ejected upwardly. When the user releases the button 38, the inserting blocks 37 will move to the bottom edges of the button 38 so that the rectangular teeth 223 and the rectangular dents 371 will engage with each other. Referring to FIG. 4, the device of the invention is in an inoperation state. The user presses the button 38 and the grip 21 into the seat 30, and the user releases the button 38 so that the rectangular teeth 223 and the rectangular dents 371 will engage with each other.

The invention is not limited to the above embodiment but various modification thereof may be made. It will be understood by those skilled in the art that various changes in form and detail may be made without departing from the scope of the invention.

I claim:

1. A suitcase comprising:

an interior to receive a seat;

a hollow top frame disposed on said seat and placed on an upper periphery of said suitcase;

said hollow top frame having a generally U-shaped groove to receive a generally U-shaped grip of a retractable handle and a rectangular hole to receive a button;

two opposite flanges protruded inwardly in two sides of said hollow top frame in order to restrict a generally U-shaped top cover plate;

said retractable handle having said generally U-shaped grip with two square holes at two ends of said generally U-shaped grip and two parallel inner pipes which has corresponding upper ends inserted in said square holes of said generally U-shaped grip;

an inner plate disposed in each said inner pipe;

an elongated recess defined between each said inner pipe and each said corresponding inner plate to face said seat and to receive a rack which has a plurality of rectangular teeth on a surface of said rack;

each said inner pipe inserted in a corresponding outer pipe and moved in said corresponding outer pipe freely;

two opposite rectangular recesses formed in two ends of said U-shaped groove longitudinally to receive two rectangular springs, respectively;

each said rectangular spring enclosing an upper portion of each said corresponding inner pipe, respectively, to eject each said corresponding inner pipes upward while said rectangular springs push upward against said cover plate which in turn pushes said U-shaped grip;

said generally U-shaped top cover plate covering said U-shaped groove;

said generally U-shaped cover plate having a square hole at each end thereon;

a rectangular through hole formed under each rectangular recess to receive a respective one of said outer pipes;

each said outer pipe having a rectangular opening facing said seat;

a chamber formed in said seat;

two opposite rectangular slots formed in said two rectangular through holes respectively;

a positioning plate disposed beneath each said rectangular slot transversely;

an L-shaped rail plate disposed above each said rectangular slot transversely;

two inserting blocks inserted in said corresponding rectangular slots;

each said inserting block restricted between each said corresponding positioning plate and each said corresponding L-shaped rail plate, respectively;

an outer end of each said inserting block having a plurality of rectangular dents passing through each said corresponding rectangular slot and each said corresponding rectangular opening to match said rectangular teeth of said rack;

two opposite protrusions disposed on a front and rear surfaces of each said inserting block to be hooked by two extension springs;

said button which has a main body with two opposite lateral notches and a pressing portion on said main body is disposed between said two L-shaped rail plates;

said inserting blocks each inserted in one of said corresponding lateral notches to restrict a transverse motion of said button;

two positioning pipes disposed adjacent one of said corresponding L-shaped rail plates, respectively;

a front cover plate which has two round holes to match said corresponding positioning pipes covering a front opening of said seat; and a compression spring disposed beneath a bottom of said button in said seat to push said button upward thereby forcing each of the inserting blocks out of the lateral notches and through a corresponding one of the rectangular slots and a corresponding rectangular opening such that the rectangular dents on the inserting blocks engage the rectangular teeth to secure the retractable handle.

* * * * *